US005411931A

United States Patent [19]

Kung

[11] Patent Number: 5,411,931

[45] Date of Patent: May 2, 1995

[54] THERMAL DYE TRANSFER RECEIVING ELEMENT WITH POLYCARBONATE POLYOL CROSSLINKED POLYMER

[75] Inventor: Teh-Ming Kung, Rochester, N.Y.

[73] Assignee: Eastman Kodak Company, Rochester, N.Y.

[21] Appl. No.: 265,604

[22] Filed: Jun. 24, 1994

[51] Int. Cl.[6] ..... B41M 5/035; B41M 5/38

[52] U.S. Cl. ..... 503/227; 428/195; 428/412; 428/423.1; 428/704; 428/913; 428/914

[58] Field of Search ..... 8/471; 428/195, 412, 428/423.1, 913, 914, 704; 503/227

[56] References Cited

U.S. PATENT DOCUMENTS

| | | | |
|---|---|---|---|
| 5,266,551 | 11/1993 | Bailey et al. | 503/227 |
| 5,284,815 | 2/1994 | Uytterhooven et al. | 503/227 |
| 5,296,446 | 3/1994 | Fujimura et al. | 503/227 |
| 5,314,861 | 5/1994 | Morohoshi et al. | 503/227 |

*Primary Examiner*—B. Hamilton Hess
*Attorney, Agent, or Firm*—Harold E. Cole

[57] ABSTRACT

A dye-receiving element for thermal dye transfer comprising a support having on one side thereof a dye image-receiving layer, wherein the dye image-receiving layer comprises a crosslinked polymer network formed by the reaction of multifunctional isocyanates with polycarbonate polyols having at least two terminal hydroxy groups and an average molecular weight of about 1000 to about 10,000, and wherein dibutyltin diacetate is used as a catalyst in crosslinking the polymer.

18 Claims, No Drawings

THERMAL DYE TRANSFER RECEIVING ELEMENT WITH POLYCARBONATE POLYOL CROSSLINKED POLYMER

This invention relates to dye-receiving elements used in thermal dye transfer, and more particularly, to such elements comprising a crosslinked polycarbonate as a dye-receiving layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, issued Nov. 4, 1986, the disclosure of which is hereby incorporated by reference.

Dye donor elements used in thermal dye transfer generally include a support bearing a dye layer comprising heat-transferable dye and a polymeric binder. Dye-receiving elements generally include a support bearing on one side thereof a dye image-receiving layer. The dye image-receiving layer conventionally comprises a polymeric material chosen from a wide assortment of compositions for its compatibility and receptivity for the dyes to be transferred from the dye donor element. The polymeric material must also provide adequate light stability for the transferred dye images. Many of the polymers which provide these desired properties, however, often lack the desired strength and integrity to stand up to the rigors of thermal printing. For example, a significant problem which can be encountered during thermal printing is sticking of the dye donor to the receiver. Gloss and abrasion resistance may also be marginal with many receiving layer polymers.

Increasing the hardness of the receiver layer with polymers having higher glass transition temperatures (Tg) can improve physical properties, but penetration of the dye into such layers may be impaired.

An alternate approach to achieve improved film properties is to crosslink the polymer. Crosslinking may be achieved in a variety of different ways, including reaction curing, catalyst curing, heat curing, and radiation curing. In general, a crosslinked polymer receiver layer may be obtained by crosslinking and curing a polymer having a crosslinkable reaction group with an additive likewise having a crosslinkable reaction group, as is discussed in EPO 394 460, the disclosure of which is incorporated by reference. This reference, e.g., discloses receiving layers comprising polyester polyols crosslinked with multifunctional isocyanates. While such crosslinked polyester receiving layers are generally superior in resistance to sticking compared to non-crosslinked polyesters, light stability for transferred image dyes may still be a problem.

U.S. Pat. No. 5,266,551 describes dye-receiving elements based on crosslinked polycarbonate polyol systems which have superior performance in regard to image stability, fingerprint resistance, and other desirable properties. However, a problem has developed with these polymeric systems in that a post-curing step is required to complete the crosslinking reaction which is separate from the film-forming process, i.e., after the coating and drying steps. This required heat-curing step may result in nonuniform crosslinking of the dye-receiving layer due to undesirable heat transfer. Further, curling of the web may take place if the post-curing step is done when the web is rolled up. It is an object of this invention to provide a way in which complete crosslinking of these receiving elements can be achieved during the film-forming process, i.e., during coating and drying of the image-receiving layer itself.

These and other objects are achieved in accordance with this invention which relates to a dye-receiving element for thermal dye transfer comprising a support having on one side thereof a dye image-receiving layer, wherein the dye image-receiving layer comprises a crosslinked polymer network formed by the reaction of multifunctional isocyanates with polycarbonate polyols having two terminal hydroxy groups and an average molecular weight of about 1000 to about 10,000, and wherein dibutyltin diacetate is used as a catalyst in crosslinking said polymer.

In accordance with this invention, it was found that the crosslinking reaction can be substantially accelerated when dibutyltin diacetate, instead of dibutyltin dilaurate as used in the prior art, is used as the catalyst for the reaction of multifunctional isocyanates with polycarbonate polyols, while the superior properties, such as image stability and fingerprint resistance, of the resulting image-receiving layer are still obtained.

Any amount of dibutyltin diacetate catalyst can be used which is effective for the intended purpose. In general, good results have been obtained when dibutyltin diacetate is used in an amount of from about 0.5 to about 4% by weight, based on the weight of the isocyanate.

Another embodiment of the invention relates to a process of preparing a dye-receiving element comprising coating a support with a dye image-receiving layer coating comprising a mixture of multifunctional isocyanates and polycarbonate polyols having at least two terminal hydroxy groups and an average molecular weight of about 1000 to about 10,000 in the presence of a dibutyltin diacetate catalyst, and then drying the receiving layer to form a crosslinked polymer network.

The crosslinked polymer network formed by the reaction of multifunctional isocyanates with polycarbonate polyols may be represented by the following formula:

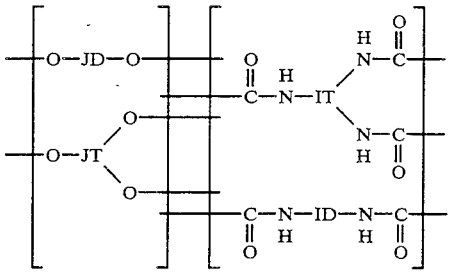

where JD and JT together represent from 50 to 100 mol % polycarbonate segments derived from polycarbonate polyols having an average molecular weight of from about 1000 to about 10,000, and ID and IT represent aliphatic, cycloaliphatic, araliphatic, or aromatic radicals of multifunctional isocyanate units.

JD represents polycarbonate segments derived from difunctional polycarbonate polyols, i.e., polycarbonate polyols having only two terminal hydroxy groups. JT represents polycarbonate segments derived from tri- and higher functional polycarbonate polyols, i.e., polycarbonate polyols having additional hydroxy groups in addition to two terminal hydroxy groups. A combination of different polycarbonate segments JD and JT of similar or different molecular weights may be used. Optionally, up to a combined 50 mol % of JD and JT may represent segments derived from polyols having a molecular weight of less than about 1000, including monomeric diols (e.g., bisphenol A bis(hydroxyethyl) ether) and triols (e.g., glycerol) or higher functional polyols (e.g., pentaerythritol). The monomeric diols provide short linkages between the isocyanate monomers and are sometimes referred to as "hard segments".

IT represents the radical of a multifunctional isocyanate containing at least three isocyanate groups, such as Desmodur N-3300® (Miles Inc.), which is 1,3,5-tris(6-isocyanatohexyl)-1,3,5-triazine-2,4,6-(1H,3H,5H)-trione, having a CAS Registration Number 3779-63-3. Higher functionality isocyanates, such as polydisperse extensions of monomeric isocynates may also be used to create additional crosslinks. ID represents the radical of a difunctional isocyanate, such as hexamethylene diisocyanate, which may be included to extend the network without creating additional crosslinks. Preferably, at least 10 mol %, more preferably at least 50 mol %, of the isocyanate units are at least trifunctional.

Polycarbonate polyols may be represented by the following general formula:

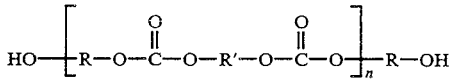

where R and R' may be the same or different and represent divalent aliphatic or aromatic radicals. The polycarbonate polyols may be formed by the reaction of a bis(chloroformate) with a diol. One of the monomers is used in excess to limit and control the molecular weight of the resulting polycarbonate polyol. As shown in the figure below, the diol is in excess and becomes the end group. Alternatively, the bis(chloroformate) could be in excess to give a chloroformate-terminated oligomer which is then hydroyzed to form a hydroxyl end group. Therefore, polyols can be prepared from these monomers with either R or R' in excess.

General Polycarbonate Polymerization Reaction

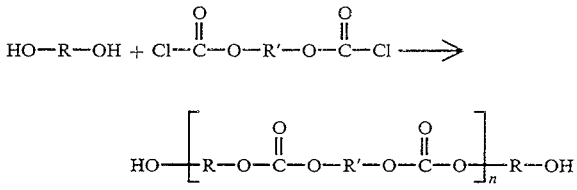

Examples of bis(chloroformates) which can be used include diethylene glycol bis(chloroformate), butanediol bis(chloroformate), and bisphenol A bis(chloroformate).

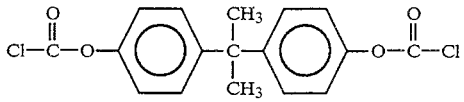

Bisphenol A bis(chloroformate)

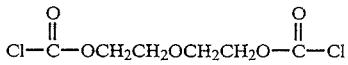

Diethylene glycol bis(chloroformate)

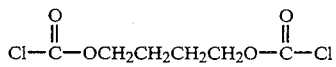

Butanediol bis(chloroformate)

Examples of diols which can be used are bisphenol A, diethylene glycol, butanediol, pentanediol, nonanediol, 4,4'-bicyclo(2,2,2)hept-2-ylidenebisphenol, 4,4'-(octahydro-4,7-methano5H-inden-5-ylidene) bisphenol, and 2,2',6,6'-tetrachlorobisphenol A.

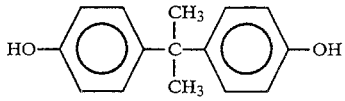

Bisphenol A

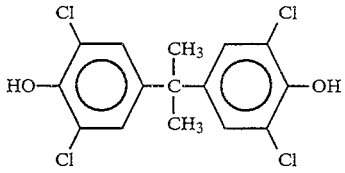

2,2',6,6'-Tetrachlorobisphenol A

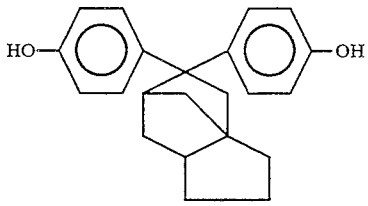

4,4'-(Octahydro-4,7-methnano-5H-inden-5-ylidene)bisphenol

-continued

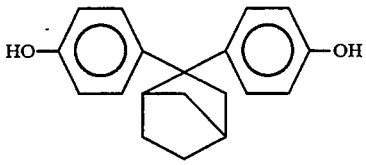

4,4'-Bicyclo(2,2,2)hept-2-ylidenebisphenol

The above monomers and other aliphatic and aromatic diols may be combined to form a variety of compositions, chain lengths and end groups. The polyol could have terminal aliphatic hydroxyl groups (e.g., diethylene glycol ends) or phenolic terminal groups (e.g., bisphenol A ends). One such structure based on bisphenol A and diethylene glycol with aliphatic hydroxyl end groups is as follows.

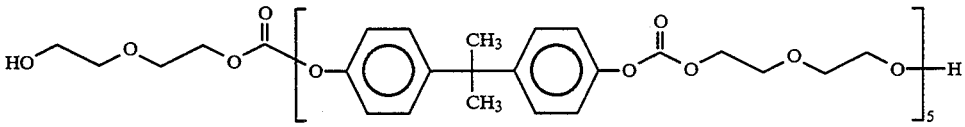

The chain length shown is 5 which would give a molecular weight of 2,040. A reasonable working range is from about 1000 to about 10,000, more preferably from about 1000 to about 5,000. Polyols of shorter chain length, or the monomers themselves, may also be incorporated into the crosslinked network.

The polycarbonate polyol is then formulated with a multifunctional isocyanate such as Desmodur N-3300® to give a crosslinked network of the general structure shown. The reaction catalyst dibutyltin diacetate is then used to facilitate the crosslinking reaction.

The support for the dye-receiving element of the invention may be a polymeric paper, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference.

The invention polymers may be used in a receiving layer alone or in combination with other receiving layer polymers. Receiving layer polymers which may be used with the polymers of the invention include polycarbonates, polyurethanes, polyesters, poly(vinyl chloride), poly(styrene-co-acrylonitrile), poly(caprolactone) or any other receiver polymer and mixtures thereof.

The dye image-receiving layer may be present in any amount which is effective for its intended purpose. In general, good results have been obtained at a receiver layer concentration of from about 0.5 to about 10 g/m$^2$.

While the receiving layer of the invention comprising a crosslinked polymer network formed by the reaction of multifunctional isocyanates with polycarbonate polyols inherently provides resistance to sticking during thermal printing, sticking resistance may be even further enhanced by the addition of release agents to the dye receiving layer, such as silicone-based compounds, as is conventional in the art.

Dye-donor elements that are used with the dye-receiving element of the invention conventionally comprise a support having thereon a dye-containing layer. Any dye can be used in the dye-donor employed in the invention provided it is transferable to the dye-receiving layer by the action of heat. Especially good results have been obtained with sublimable dyes. Dye-donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

The following examples are provided to further illustrate the invention.

Structures of some of the materials used in the experiments detailed in Example 1 through 3 below are shown here:

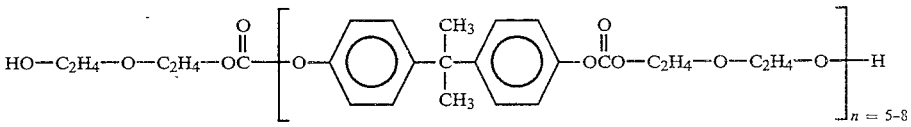

POL = polycarbonate polyol

+

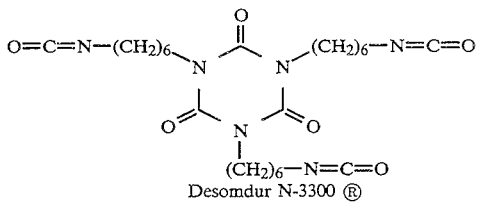

Desomdur N-3300 ® crosslinking catalyst

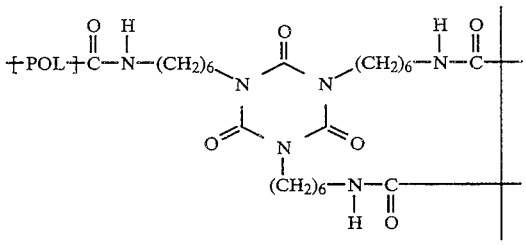

POL crosslinked with Desomdur N-3300 ®

EXAMPLE 1

Comparison of Catalysts

Two sample solutions of approximately 15 g each in a separate glass vial were prepared by dissolving POL and Desmodur N-3300 ® in ethyl acetate at an OH/-NCO equivalent weight ratio of 0.75:1. The solutions were stirred and catalysts added: Metacure T-1 ® (dibutyltin diacetate, Air Products Corp.) was added to one sample, and Metacure T-12 ® (dibutyltin dilaurate, Air Products Corp.) was added to the other sample in amounts of 1.1 wt-% and 2 wt-% of the total added polyisocyanate so that both catalysts could be compared on an equimolar basis. Clear ethyl acetate solutions with a total solid content of approximately 27 wt-% were obtained. After brief stirring, the solutions in their respective glass vials with lids on were subjected to a gel time evaluation at 20° C. and 50% RH (relative humidity) with the following results:

TABLE 1

| Element | Components | Total Solid wt % | Gel Time (min) |
|---|---|---|---|
| Control | POL | 77.7 | 220 ± 10 |
| | Desmodur N-3300 ® | 21.9 | |
| | Dibutyltin dilaurate | 0.4 | |
| E-1 | POL | 77.83 | 120 ± 10 |
| | Desmodur N-3300 ® | 21.93 | |
| | Dibutyltin diacetate | 0.24 | |

The above results show that a longer gel time was obtained for the control which indicates a less efficient catalyst for this particular crosslinking system.

EXAMPLE 2

Two separate sample solutions of approximately 20 g each were prepared in two glass vials by mixing POL and Desmodur N-3300 ® as described in Example 1. However, this time diphenyl phthalate (DPP) and Fluorad FC-431 ® fluorinated surfactant (3M Corp.) were added to the samples prior to addition of the respective catalysts again in the amount of 1.1 wt-% and 2 wt-% of total added polyisocyanate so that the catalysts could be compared on an equimolar basis. Both samples were again conditioned at 20° C. and 50% RH to evaluate gel times with the following results:

TABLE 2

| Element | Components | Total Solid wt % | Gel Time, (min.) |
|---|---|---|---|
| Control | POL | 68.3 | 270 |
| | Desmodur N-3300 ® | 19.2 | |
| | Dibutyltin dilaurate | 0.4 | |
| | DPP | 11.9 | |
| | FC-431 | 0.2 | |
| E-2 | POL | 68.4 | 195 |
| | Desmodur N-3300 ® | 19.3 | |
| | Dibutyltin diacetate | 0.2 | |
| | DPP | 11.9 | |
| | FC-431 | 0.2 | |

The above results again show,that a longer gel time was obtained for the control which indicates a less efficient catalyst for this particular crosslinking system.

EXAMPLE 3

Two sample solutions were prepared as described in Example 2. The clear solutions had total solid contents of approximately 18 wt-% each. After brief stirring to assure uniform mixing, the solutions were immediately hopper-coated on a receiver support in sequence at a traveling speed of 7.62 m/min. and a drying temperature of 98.9° C. The total residence time of coated receiver in the drying sections of the coating machine was about 6 min. The catalyst was added immediately before the solution was queued up for its coating run.

A dye donor element of sequential areas of cyan, magenta, and yellow dye was prepared and used for printing the above-prepared receiver samples as described in detail in U.S. Pat. No. 5,272,378, col. 6 line 42 through col. 8 line 28. The coated receiver samples were cut into sample pieces of 10.2 cm×14 cm size and printed with a patched color pattern of 11 gradations (Fresh). The receivers were then incubated for four days at 60° C. (Incubated).

The difference in optical density between room-set and cured receivers served as measure for the completeness of the crosslinking reaction achieved for the coated receiver during the coating and drying process. The larger this difference was found to be, the more incomplete was the crosslinking reaction, thereby leaving a greater uncrosslinked fraction of species in the matrix of the coated receiver. The following results were obtained:

TABLE 3

| | | OPTICAL DENSITY | | | |
|---|---|---|---|---|---|
| SAMPLE | CONDITIONS | Step 5 | Step 7 | Step 9 | Step 11 |
| Control-3 (yellow) | Fresh | 1.09 | 1.67 | 2.12 | 2.51 |
| | Incubated | 0.97 | 1.48 | 1.97 | 2.38 |
| | Difference (%) | 11 | 11.3 | 7.10 | 5.20 |
| E-3 (yellow) | Fresh | 1.07 | 1.65 | 2.10 | 2.51 |
| | Incubated | 1.00 | 1.59 | 2.03 | 2.45 |
| | Difference (%) | 6.50 | 3.60 | 3.30 | 2.40 |
| Control-3 (magenta) | Fresh | 1.11 | 1.69 | 2.10 | 2.59 |
| | Incubated | 1.04 | 1.55 | 1.96 | 2.45 |
| | Difference (%) | 6.30 | 8.30 | 6.70 | 5.40 |
| E-3 (magenta) | Fresh | 1.08 | 1.61 | 2.05 | 2.53 |
| | Incubated | 1.06 | 1.59 | 2.01 | 2.47 |
| | Difference (%) | 1.90 | 1.20 | 2.00 | 2.40 |
| Control-3 (cyan) | Fresh | 1.02 | 1.51 | 1.85 | 2.29 |
| | Incubated | 0.94 | 1.39 | 1.68 | 2.01 |
| | Difference (%) | 7.80 | 7.90 | 9.20 | 12.2 |
| E-3 (cyan) | Fresh | 1 | 1.45 | 1.78 | 2.16 |
| | Incubated | 0.96 | 1.42 | 1.72 | 2.06 |
| | Difference (%) | 4 | 2.10 | 3.40 | 4.60 |

The above results show that samples E-3 using dibutyltin diacetate as a .catalyst have a significantly lower difference in the optical density values obtained as a result of the transfer of all three colors (yellow, magenta, cyan) before and after incubation compared to the differences when dibutyltin dilaurate was used as catalyst.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer, wherein said dye image-receiving layer comprises a crosslinked polymer network formed by the reaction of multifunctional isocyanates with polycarbonate polyols having at least two terminal hydroxy groups and an average molecular weight of about 1000 to about 10,000, and wherein dibutyltin diacetate is used as a catalyst in crosslinking said polymer.

2. The element of claim 1 wherein said crosslinked polymer network has the formula:

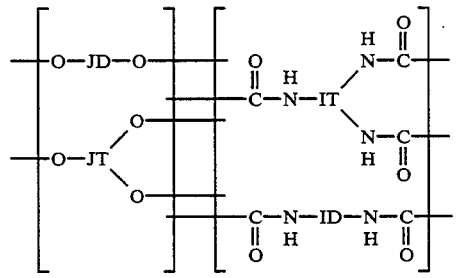

wherein

JD and JT together represent from 50 to 100 mol % polycarbonate segments derived from polycarbonate polyols having an average molecular weight of from about 1000 to about 10,000 and from 0 to 50 mol % segments derived from polyols having a molecular weight of less than about 1000, and ID and IT represent aliphatic, cycloaliphatic, araliphatic, or aromatic radicals of multifunctional isocyanate units.

3. The element of claim 1 wherein said polycarbonate polyols comprise bisphenol A derived units and diethylene glycol derived units.

4. The element of claim 1 wherein the terminal hydroxy groups of the polycarbonate polyols comprise aliphatic hydroxyl groups.

5. The element of claim 1 wherein the terminal hydroxy groups of the polycarbonate polyols comprise phenolic groups.

6. The element of claim 1 wherein the terminal hydroxy groups of the polycarbonate polyols comprise a mixture of phenolic groups and aliphatic hydroxyl groups.

7. The element of claim 1 wherein at least 50 mol % of the multifunctional isocyanates are at least trifunctional.

8. The element of claim 1 wherein said polyols and multifunctional isocyanates are reacted to form the crosslinked polymer network in amounts such that the equivalents of polyol hydroxyl groups are from 60 to 100% of the equivalents of isocyanate groups.

9. The element of claim 1 wherein said dibutyltin diacetate is used at an amount of from about 0.5 to about 4% by weight, based on the weight of said isocyanate.

10. A process of forming a dye transfer image by imagewise-heating a dye-donor element and transferring a dye image to a dye-receiving element, said dye-receiving element comprising a dye image-receiving layer comprising a crosslinked polymer network formed by the reaction of multifunctional isocyanates and polycarbonate polyols having two terminal hydroxy groups and an average molecular weight of about 1000 to about 10,000 in the presence of a dibutyltin diacetate catalyst.

11. The process of claim 10 wherein said crosslinked polymer network has the formula:

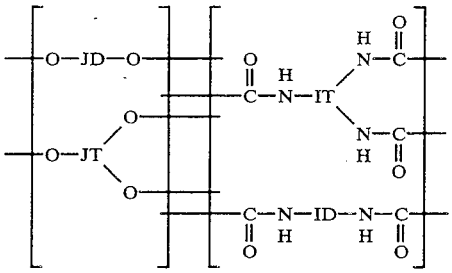

where

JD and JT together represent from 50 to 100 mol % polycarbonate segments derived from polycarbonate polyols having an average molecular weight of from about 1000 to about 10,000 and from 0 to 50 mol% segments derived from polyols having a molecular weight of less than about 1000, and ID and IT represent aliphatic, cycloaliphatic, araliphatic, or aromatic radicals of multifunctional isocyanate units.

12. The process of claim 10 wherein said polycarbonate polyols comprise bisphenol A derived units and diethylene glycol derived units.

13. The process of claim 10 wherein the terminal hydroxy groups of the polycarbonate polyols comprise aliphatic hydroxyl groups.

14. The process of claim 10 wherein the terminal hydroxy groups of the polycarbonate polyols comprise phenolic groups.

15. The process of claim 10 wherein the terminal hydroxy groups of the polycarbonate polyols comprise a mixture of phenolic groups and aliphatic hydroxyl groups.

16. The process of claim 10 wherein at least 50 mol % of the multifunctional isocyanates are at least trifunctional.

17. The process of claim 10 wherein said polyols and multifunctional isocyanates are reacted to form the crosslinked polymer network in amounts such that the equivalents of polyol hydroxyl groups are from 60 to 100% of the equivalents of isocyanate groups.

18. The process of claim 10 wherein said dibutyltin diacetate is used at an amount of from about 0.1 to about 4% by weight, based on the weight of said isocyanate.

* * * * *